US006601425B2

(12) United States Patent
Hung

(10) Patent No.: US 6,601,425 B2
(45) Date of Patent: Aug. 5, 2003

(54) AUTOMATIC EXTRUDING MACHINE

(75) Inventor: Shui-Shu Hung, Yung Kang (TW)

(73) Assignee: Catcher Technology Co., Ltd., Yung Kang (TW)

( * ) Notice: Subject to any disclaimer, the term of this patent is extended or adjusted under 35 U.S.C. 154(b) by 17 days.

(21) Appl. No.: 10/040,733

(22) Filed: Jan. 4, 2002

(65) Prior Publication Data

US 2002/0088601 A1 Jul. 11, 2002

(30) Foreign Application Priority Data

Jan. 8, 2001 (TW) ..... 90200296 U

(51) Int. Cl.[7] ..... B21C 33/00
(52) U.S. Cl. ..... 72/270; 72/253.1; 72/257
(58) Field of Search ..... 72/253.1, 257, 72/263, 270, 272, 273.5, 355.2, 355.4, 355.6

(56) References Cited

U.S. PATENT DOCUMENTS 3,216,233 A * 11/1965 Pischel et al. ..... 72/270
3,616,672 A * 11/1971 Moos ..... 72/270
4,379,398 A * 4/1983 Asari et al. ..... 72/273.5
4,606,211 A * 8/1986 Noyori et al. ..... 72/270
5,931,041 A * 8/1999 Gachy et al. ..... 72/273.5

FOREIGN PATENT DOCUMENTS

CA 938587 * 12/1973 ..... 72/257
JP 4-135012 * 5/1992 ..... 72/270

* cited by examiner

*Primary Examiner*—Ed Tolan
(74) *Attorney, Agent, or Firm*—Dellett and Walters

(57) ABSTRACT

An automatic extruding machine includes a base member, a molding device mounted on a middle portion of the base member, an input extruding device mounted on the base member and connected to the molding device, a feeding device mounted on the base member below the input extruding device, an output extruding device mounted on the base member and corresponding to the input extruding device, an exporting device mounted on the base member below the output extruding device and a cutting device mounted on the top of the molding device toward the input extruding device. The automatic extruding machine in accordance with the present invention further comprises a control unit provided to control the above devices to automatically finish the extruding process.

17 Claims, 19 Drawing Sheets

AUTOMATIC EXTRUDING MACHINE

BACKGROUND OF THE INVENTION

1. Field of the Invention

The present invention relates to an extruding machine, and more particularly to an automatic extruding machine.

2. Description of Related Art

With reference to FIG. 13, a conventional reciprocating extrusion machine in accordance with the prior art comprises an extruding mold (80) and an extruding device (90). The extruding mold (80) includes a first block (81) and a second block (82) abutting each other. A first passage (811) is defined in and extends through the first block (81), and a first recess (812) is defined in one end of the first block (81). The first recess (812) in the first block (81) communicates with the first passage (811) in the first block (81). A second passage (821) is defined in and extends through the second block (82). The second passage (821) aligns with the first passage (811) in the first block (81). A second recess (822) is defined in the second block (82) and communicates with the second passage (821). The second recess (822) and the first recess (811) form a chamber (800) between the two blocks (81, 82). A third block (83) is received in the chamber (800) between the first block (81) and the second block (82). At least one through hole (831) is longitudinally defined in the third block (83) to communicate between the first passage (811) in the first block (81) and the second passage (821) in the second block (82) and allow the original alloy material to extrude from one block to the other.

The extruding device (90) includes two cylinders (not numbered) each having a piston (91, 92) movably and reciprocally mounted in a corresponding one of the passages (811, 821) to extrude the original alloy material in the extruding mold.

The conventional extruding machine can improve the physical property of an alloy. However, the conventional extruding machine does not include a feeding device and an exporting device. The alloy must be heated above the recrystallization temperature and the temperature of the extruded alloy is still very high as it exits the extruding mold. Workers may be injured by the high temperature of the alloy. Actions and apparatus to prevent injuries associated with the conventional extruding equipment will reduce the manufacturing productivity.

The present invention has arisen to mitigate and/or obviate the disadvantages of the conventional extruding machine.

SUMMARY OF THE INVENTION

The main objective of the present invention is to provide an automatic extruding machine.

To achieve the objective, the automatic extruding machine in accordance with the present invention includes a base member, a molding device, an input extruding device, a feeding device, an output extruding device, an exporting device and a cutting device. The molding device is mounted on a middle portion of the base member. The input extruding device is mounted on the base member and is connected to the molding device. The feeding device is mounted on the base member below the input extruding device. The output extruding device is mounted on the base member and corresponds to the input extruding device. The exporting device is mounted on the base member below the output extruding device. The cutting device is mounted on the top of the molding device toward the input extruding device. The automatic extruding machine in accordance with the present invention further comprises a control unit provided to control the foregoing devices to automatically finish the extruding process.

Further benefits and advantages of the present invention will become apparent after a careful reading of the detailed description with appropriate reference to the accompanying drawings.

DETAILED DESCRIPTION OF THE INVENTION

Figure 1:
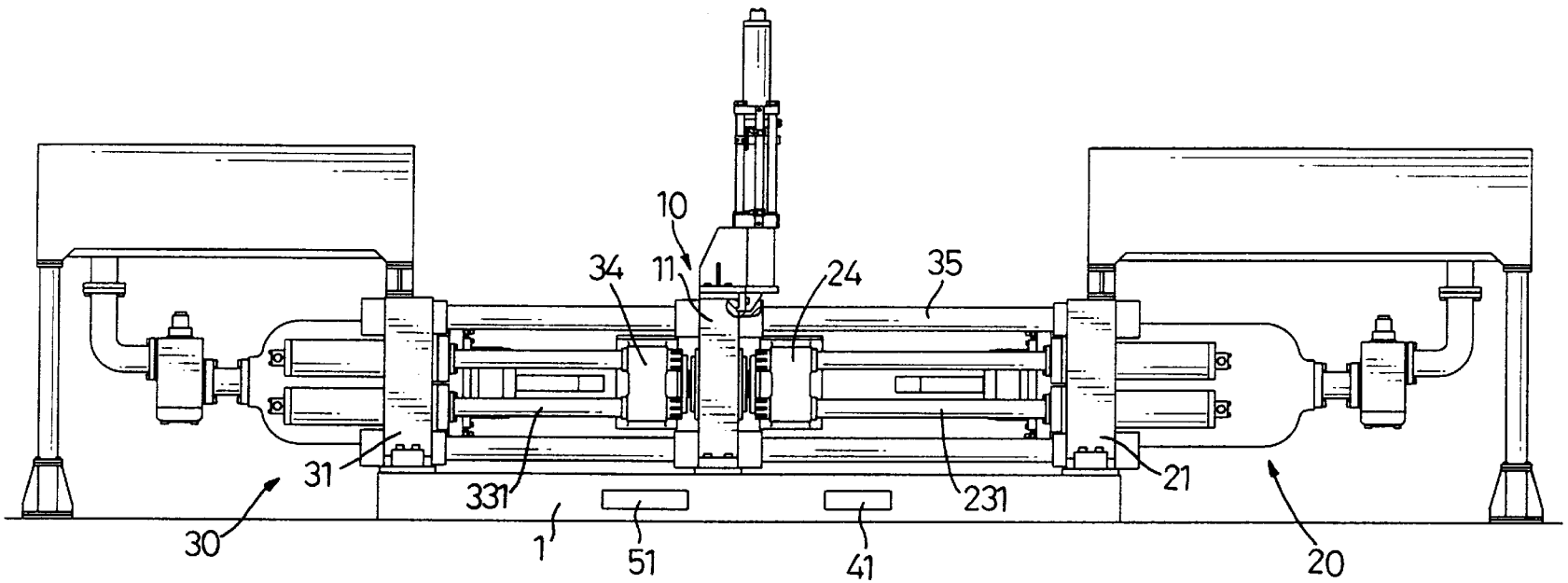
FIG. 1 is a front plan view of an automatic extruding machine in accordance with the present invention.
Figure 2A:
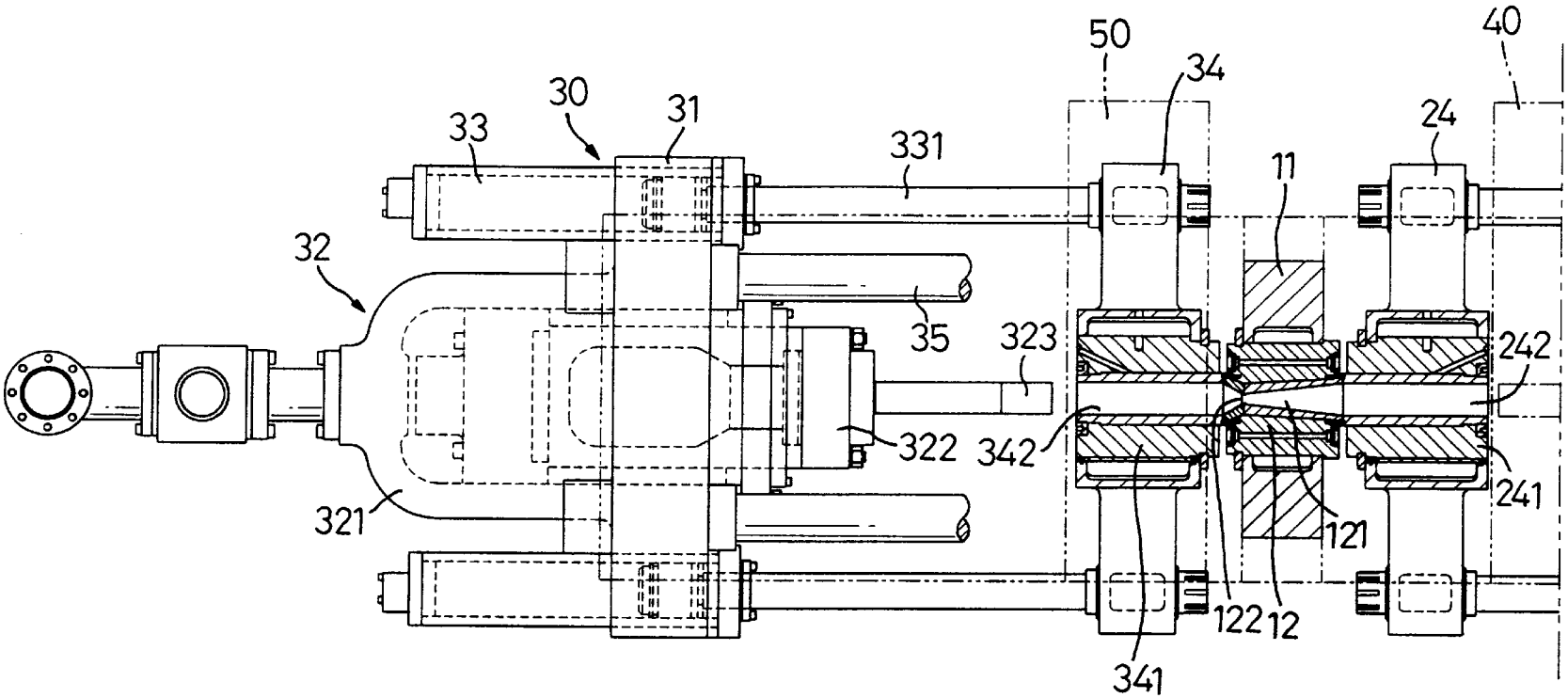
FIG. 2A is a partial top plan view in partial section of the automatic extruding machine in FIG. 1.
Figure 2B:
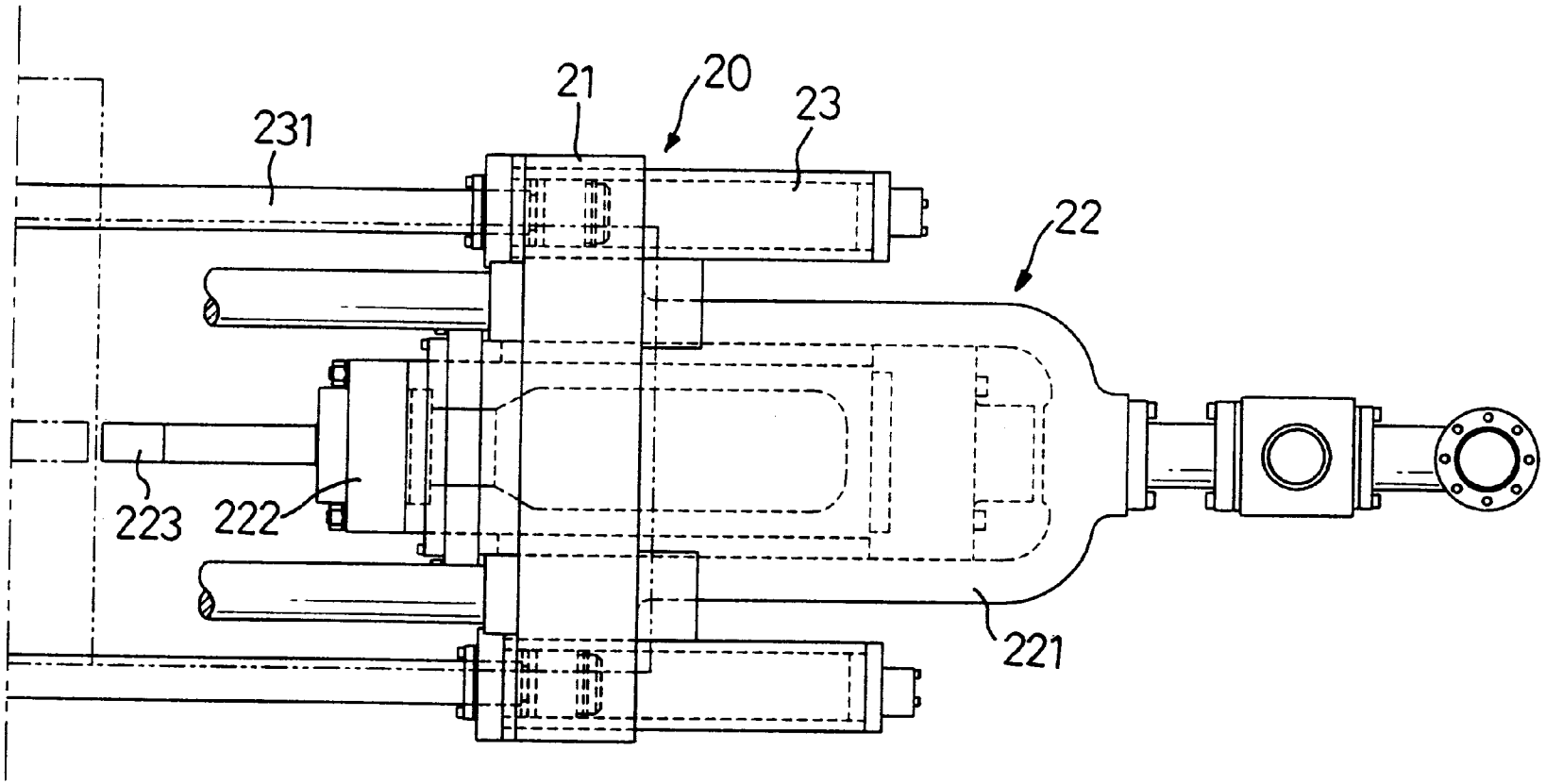
FIG. 2B is a partial top plan view in partial section of the automatic extruding machine in FIG. 1.
Figure 6:
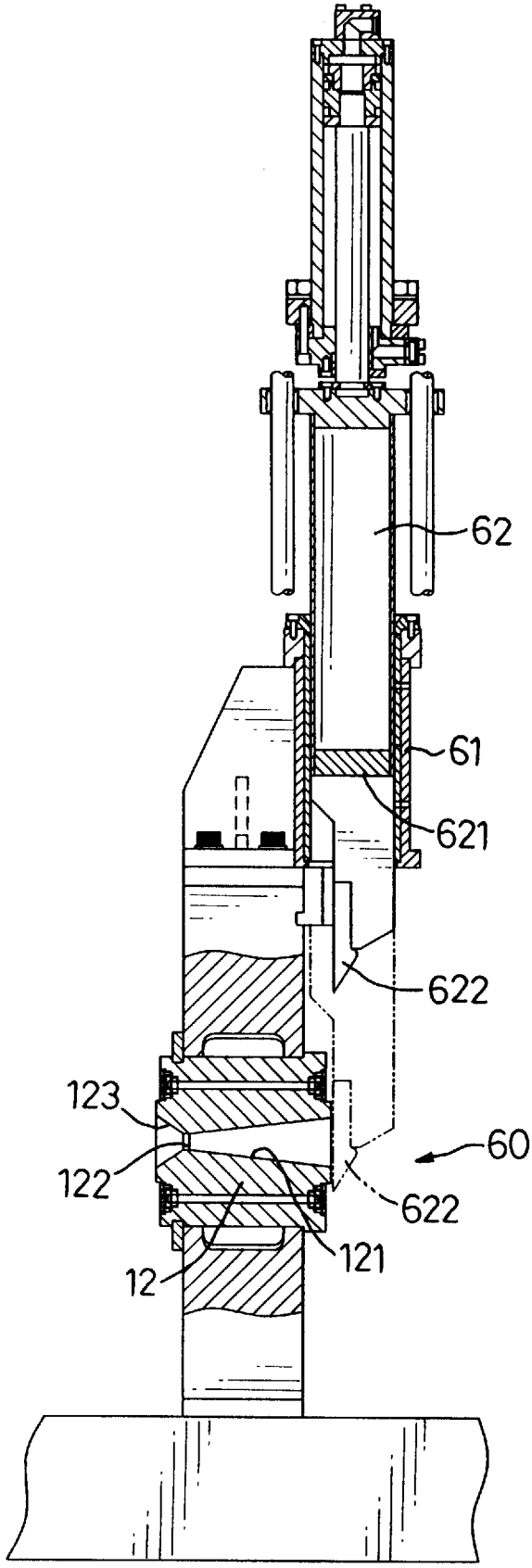
FIG. 6 is a front plan view of a cutting device of the automatic extruding machine in FIG. 1.

With reference to the drawings and initially to FIGS. 1, 2 and 6, an automatic extruding machine in accordance with the present invention comprises a base member (1), a molding device (10), an input extruding device (20), a feeding device (40), an output extruding device (30), an exporting device (50) and a cutting device (60). The molding device (10) is mounted on a middle portion of the base member (1). The input extruding device (20) is mounted on the base member (1) and connected to the molding device (10). The feeding device (40) is mounted on the base member (1) below the input extruding device (20). The output extruding device (30) is mounted on the base member (1) and corresponds to the input extruding device (20). The exporting device (50) is mounted on the base member (1) below the output extruding device (30). The cutting device (60) is mounted on the top of the molding device (10) toward the input extruding device (20). The automatic extruding machine in accordance with the present invention further comprises a control unit (not shown) provided to control the foregoing devices to finish the extruding process.

The molding device (10) comprises a frame (11) and a mold (12) detachably mounted on the frame (11). The type of mold (12) is selected based on the alloy material. The mold (12) includes a first side having a first hole (121) centrally defined in the mold (12) and a second side having a second hole (123) centrally defined in the mold (12). The first hole (121) and the second hole (123) communicate with each other. The first hole (121) has a depth deeper than that of the second hole (123), and a neck (122) is formed in the mold (12) between the first hole (121) and the second hole (123). The first hole (121) and the second hole (123) are conical and the radius of the two holes (121, 123) gradually decreases as the holes (121, 123) approach the neck (122).

Figure 3:
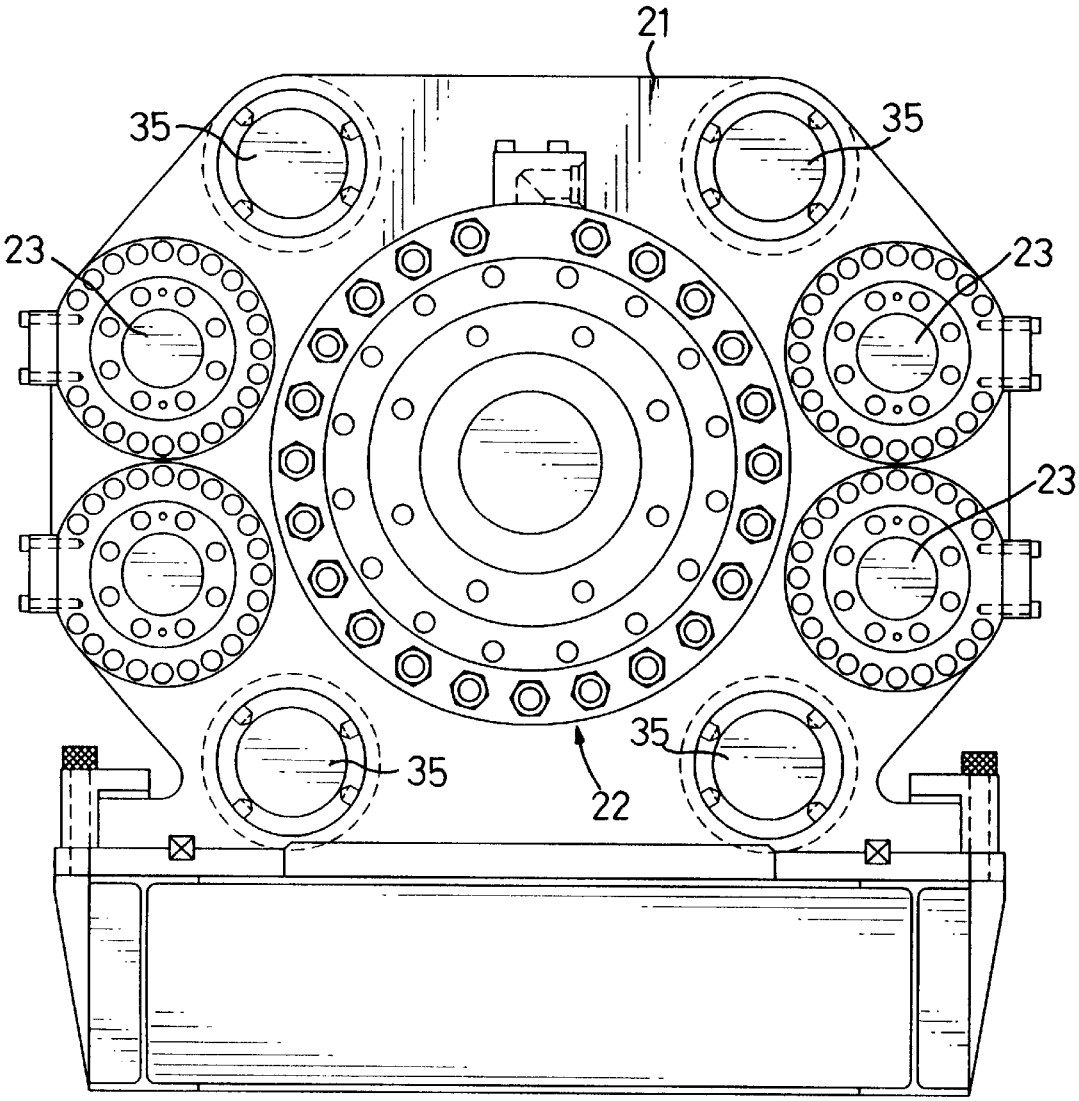
FIG. 3 is a side plan view of an extruding device of the automatic extruding machine in FIG. 1.

With reference to FIGS. 2 and 3, the input extruding device (20) is mounted to face the first side of the mold (12). The input extruding device (20) comprises a seat (21) securely attached to the base member (1) and a drive device (22) mounted on one side of the seat (21) away from the mold (12). The drive device (22) includes a main cylinder (221) extending through and securely attached to the seat (21) and a piston (222) partially reciprocally mounted in the main cylinder (221). The piston (222) is co-axial relative to the first hole (121) in the mold (12), and a hard block (223) is centrally attached to a free end of the piston (222). At least two auxiliary cylinders (23) are mounted on each seat (21) opposite to the mold (12), and each has a piston (231) reciprocally extending through the seat (21) toward the molding device (10). In the preferred embodiment of the present invention, the drive device (22) has four auxiliary cylinders (23) mounted around the main cylinder (221). A moving seat (24) is mounted on the free ends of the auxiliary cylinders (23) so that the moving seat (24) is reciprocally moved between the molding device (10) and the seat (21) of the input extruding device (20). A positioning mold (241) is mounted in and extends through the moving seat (24). The positioning mold (241) corresponds to the mold (12) and has a through hole (242) defined to align with the first hole (121) in the mold (12). The through hole (242) in the positioning mold (241) has a diameter equal to that of the first hole (121) on the first side of the mold (12) and slightly greater than that of the hard block (223).

Figure 4:
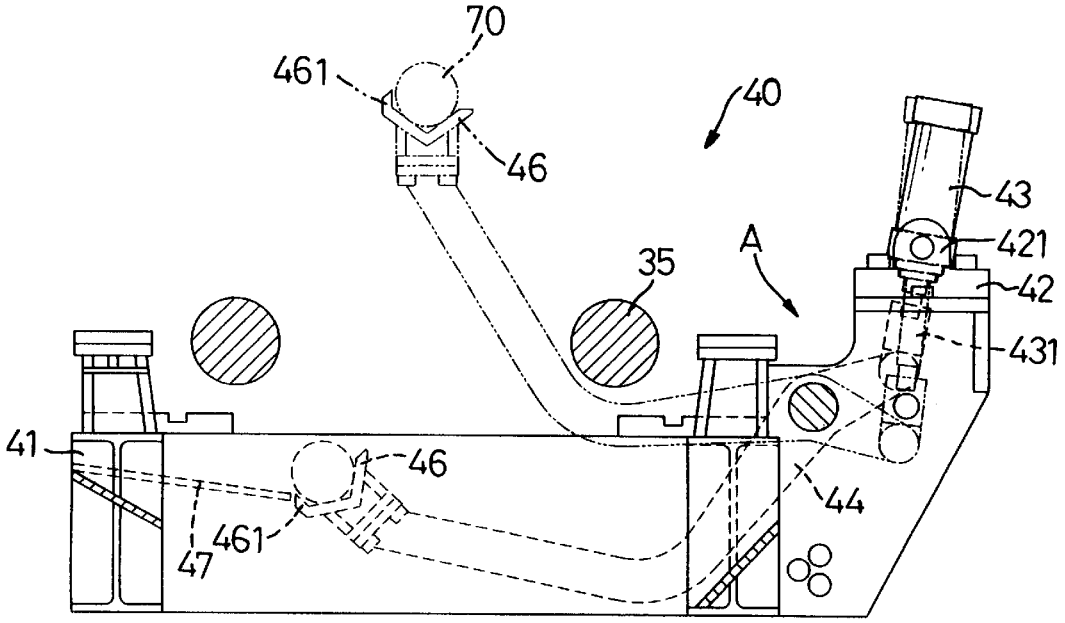
FIG. 4 is an operational side plan view of a feeding device of the automatic extruding machine in FIG. 1.

With reference to FIGS. 2 and 4, the feeding device (40) comprises an inlet (41) and an actuating device (A). The inlet (41) is defined in and extends to an outer periphery of the base member (1). The actuating device (A) is mounted in the base member (1). The actuating device (A) includes a base (42) and a pair of ears (421) extending from the base (42). A feeding cylinder (43) is pivotally mounted on the ears (421). The feeding cylinder (43) includes a piston (431) reciprocally mounted in the feeding cylinder (43). A bent arm (44) is pivotally mounted on the base member (1) and corresponds to the inlet (41). The bent arm (44) has a first end pivotally connected to a free end of the piston (431) of the feeding cylinder (43) and a second end having a V-shaped support (46) attached to the arm (44). A lip (461) extends from one side of the support (46) and corresponds to the inlet (41).

With reference to FIGS. 1, 2 and 3, the output extruding device (30) is mounted to face the second side of the mold (12), and the structure of the output extruding device (30) is the same as the input extruding device (20). The output extruding device (30) comprises a seat (31) securely attached to the base member (1) and a drive device (32) mounted on the seat (31) opposite to the mold (12). The drive device (32) of the output extruding device (30) includes a main cylinder (321) securely mounted in and extending through the seat (31) and has a piston (322) partially reciprocally received in the main cylinder (321). The piston (321) of the main cylinder (321) of the output extruding device (30) is co-axial relative to the second hole (123) in the mold (12). A hard block (323) is attached to a free end of the piston (322) of the main cylinder (321) of the output extruding device (30). At least two auxiliary cylinders (33) are mounted on the seat (31) of the output extruding device (30) opposite to the mold (12). Each auxiliary cylinder (33) of the output extruding device (30) has a piston (331) reciprocally extending through the seat (31) of the output extruding device (30) toward the molding device (10). In the preferred embodiment of the present invention, the drive device (32) of the output extruding device (30) has four auxiliary cylinders (33) mounted around the main cylinder (321) of the output extruding device (30). A moving seat (34) is mounted on the free end of the auxiliary cylinders (33) of the output extruding device (30) so that the moving seat (34) of the output extruding device (30) is reciprocally moved between the molding device (10) and the seat (34) of the output extruding device (30). A positioning mold (341) is mounted in and extends through the moving seat (31) of the output extruding device (30). The positioning mold (341) of the output extruding device (30) corresponds to the mold (12) and has a through hole (342) defined to align with the second hole (123) in the mold (12). The through hole (342) in the positioning mold (341) of the output extruding device (30) has a diameter equal to that of the second hole (123) on the second side of the mold (12) and slightly greater than that of the hard block (323) of the output extruding device (30). To linearly align and mount the seats (21, 31) of the input and output extruding devices (20, 30) relative to one another on the base member (1), multiple positioning rods (35) extend through the seats (21, 31) of the input and output extruding devices (20, 30).

Figure 5:
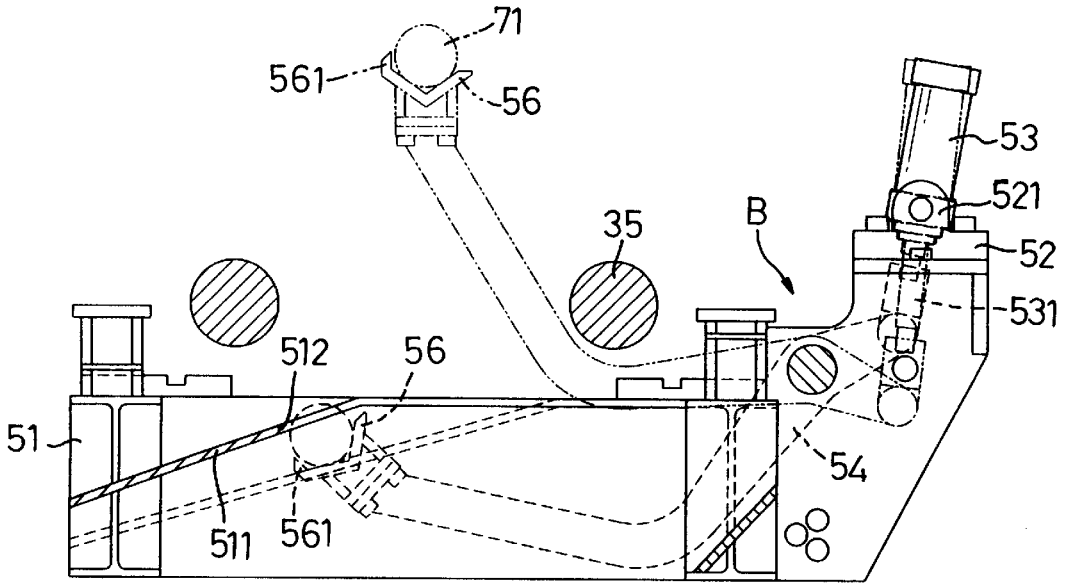
FIG. 5 is an operational side plan view of the feeding device of the automatic extruding machine in FIG. 1.

With reference to FIG. 5, the exporting device (50) comprises an outlet (51) defined and extending to the outer periphery of the base member (1) and an actuating device (B) mounted in the base member (1). The actuating device (B) includes a base (52) mounted on the base member (1) and having a pair of ears (521) extending from the base (52). A cylinder (53) is pivotally mounted on the ears (521). The cylinder (53) includes a piston (531) reciprocally mounted in the cylinder (53). A bent arm (54) is pivotally mounted on the base member (1) and corresponds to the outlet (51). The bent arm (54) includes a first end pivotally connected to a free end of the piston (53) and a second end having a V-shaped support (56) attached to the arm (54). A lip (561) extends from one side of the support (56) and corresponds to the outlet (51). A guiding plate (511) is mounted in the base member (1). The guiding plate (511) has a first end connected to a lower edge of the outlet (51) and a second end having a channel (512) defined in the guiding plate (511) to allow the support (56) to pass through the guiding plate (511). The channel (512) has a width smaller than that of the extruded alloy. The first end of the guiding plate (511) has a height lower than that of the second end of the guiding plate (511) relative to the horizon.

With reference to FIGS. 1 and 6, the cutting device (60) comprises a bracket (61) mounted on the top of the molding device (10) and a cylinder (62) mounted on the bracket (61) and directed toward the molding device (10). The cylinder (62) has a piston (621) partially reciprocally mounted in the cylinder (62). A cutter (622) is securely attached to a free end of the piston (621) and has a sharpened edge toward the molding device (10).

Figure 7A:
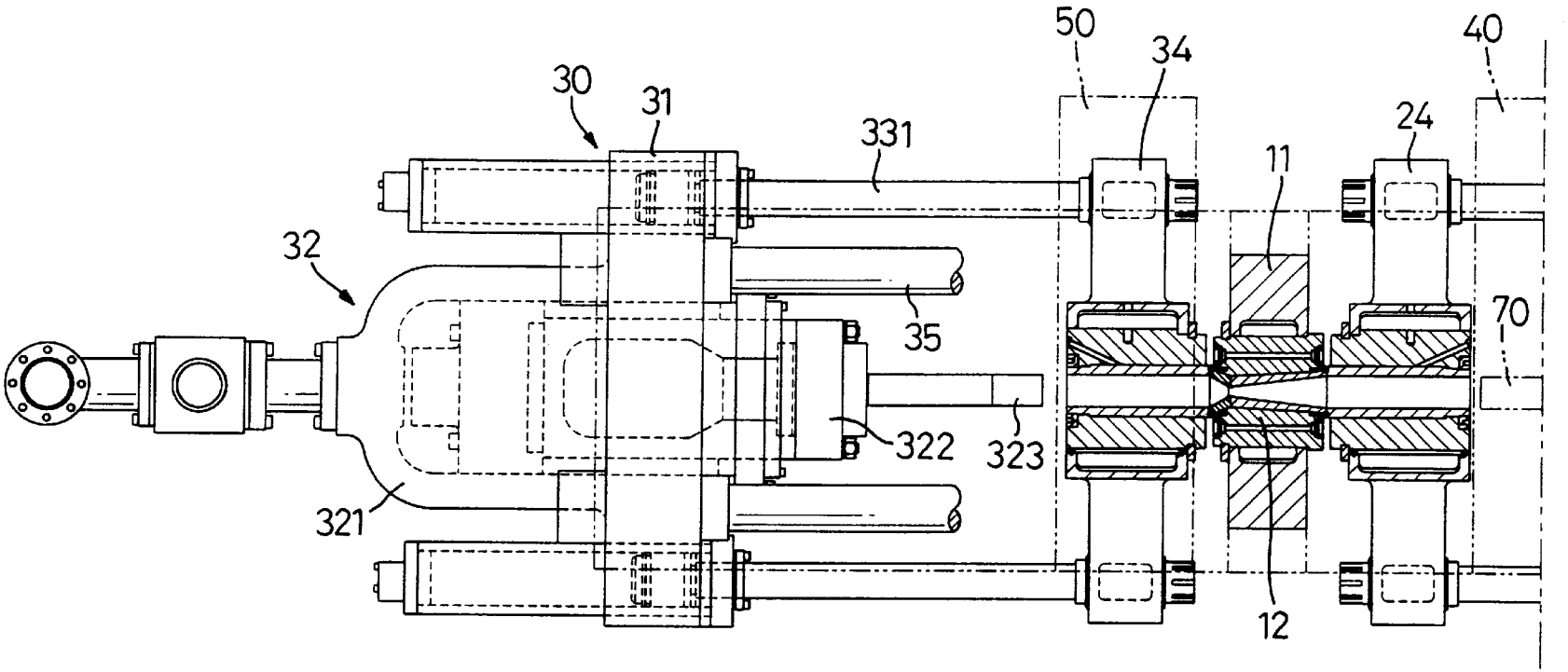
FIG. 7A is an operational partial top plan view of the automatic extruding machine in FIG. 1.
Figure 7B:
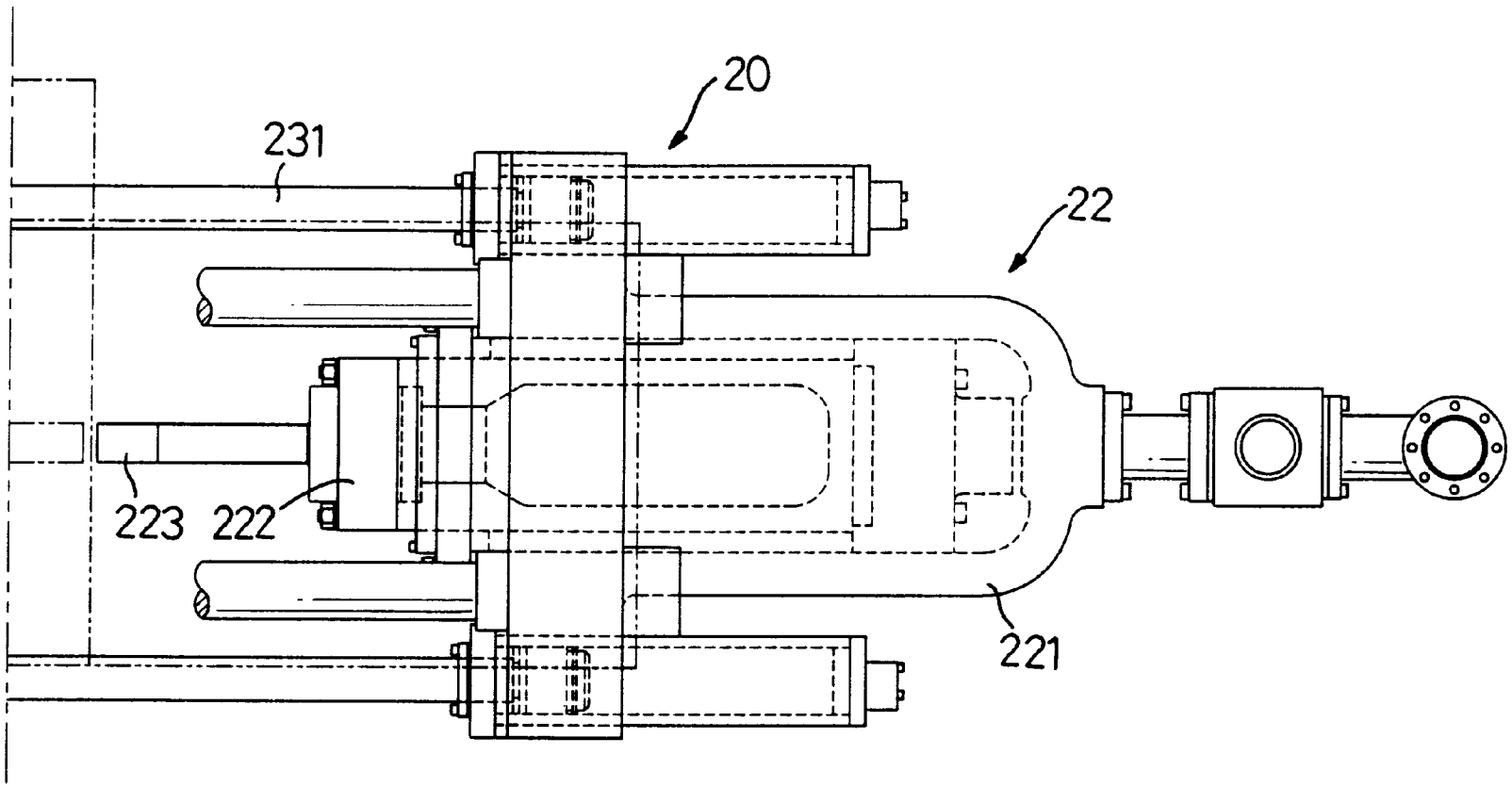
FIG. 7B is an operational partial top plan view of the automatic extruding machine in FIG. 1.

To operate the automatic extruding machine, the original alloy must be heated above the recrystallization temperature so that its coarse microstructure will be effectively refined during extruding. With reference to FIGS. 4 and 7, the piston (431) is moved back into the cylinder (43) to make the support (46) on the arm (44) move down to connected to a distal end of the guiding plate (47) so that the original alloy (70) rolls onto the support (46) along the guiding plate (47) when put into the inlet (41). Then the piston (431) extends from the cylinder (43) to lift up the arm (44) and co-axially align the original alloy with the through hole (242) in the positioning mold (241) of the input extruding device (20).

Figure 8A:
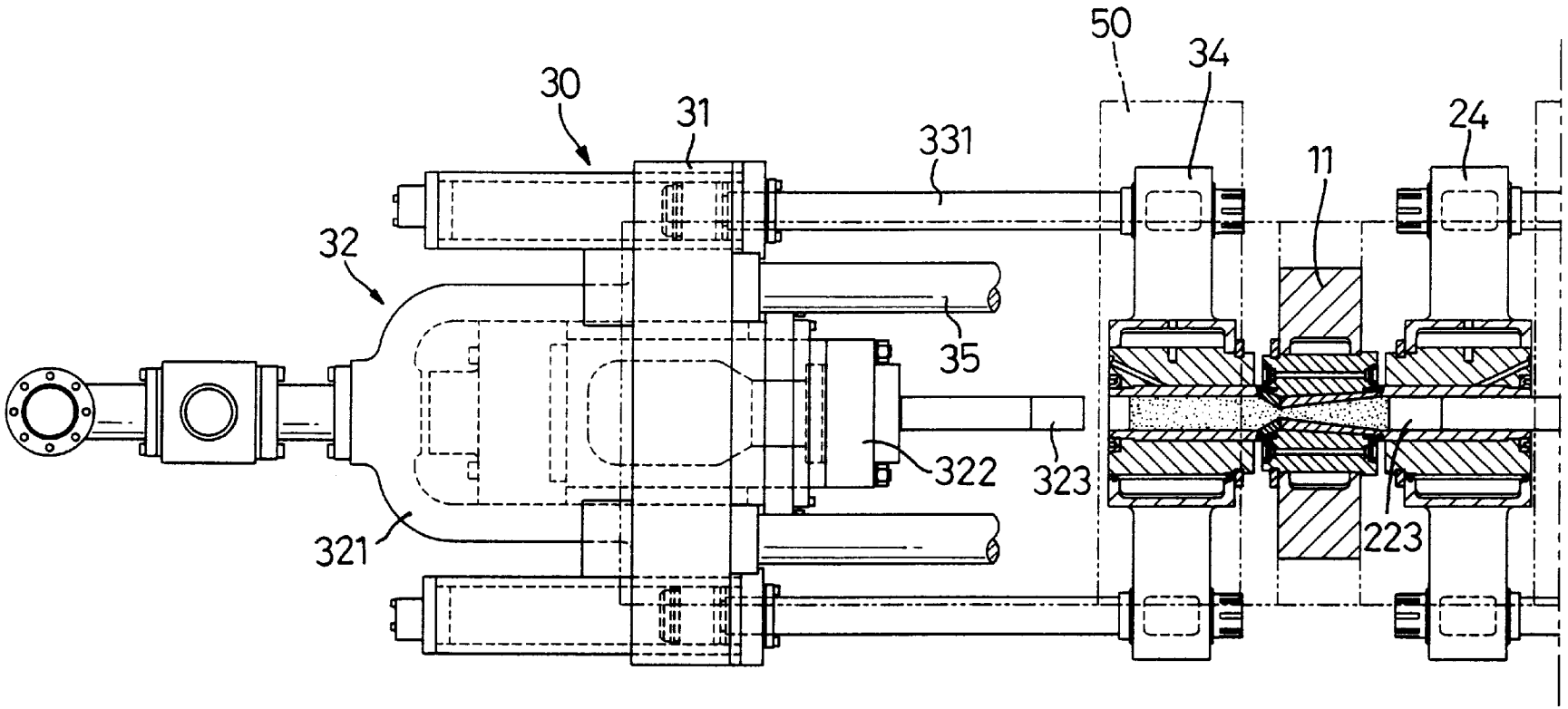
FIG. 8A is an operational partial top plan view of the automatic extruding machine in FIG. 1.
Figure 8B:
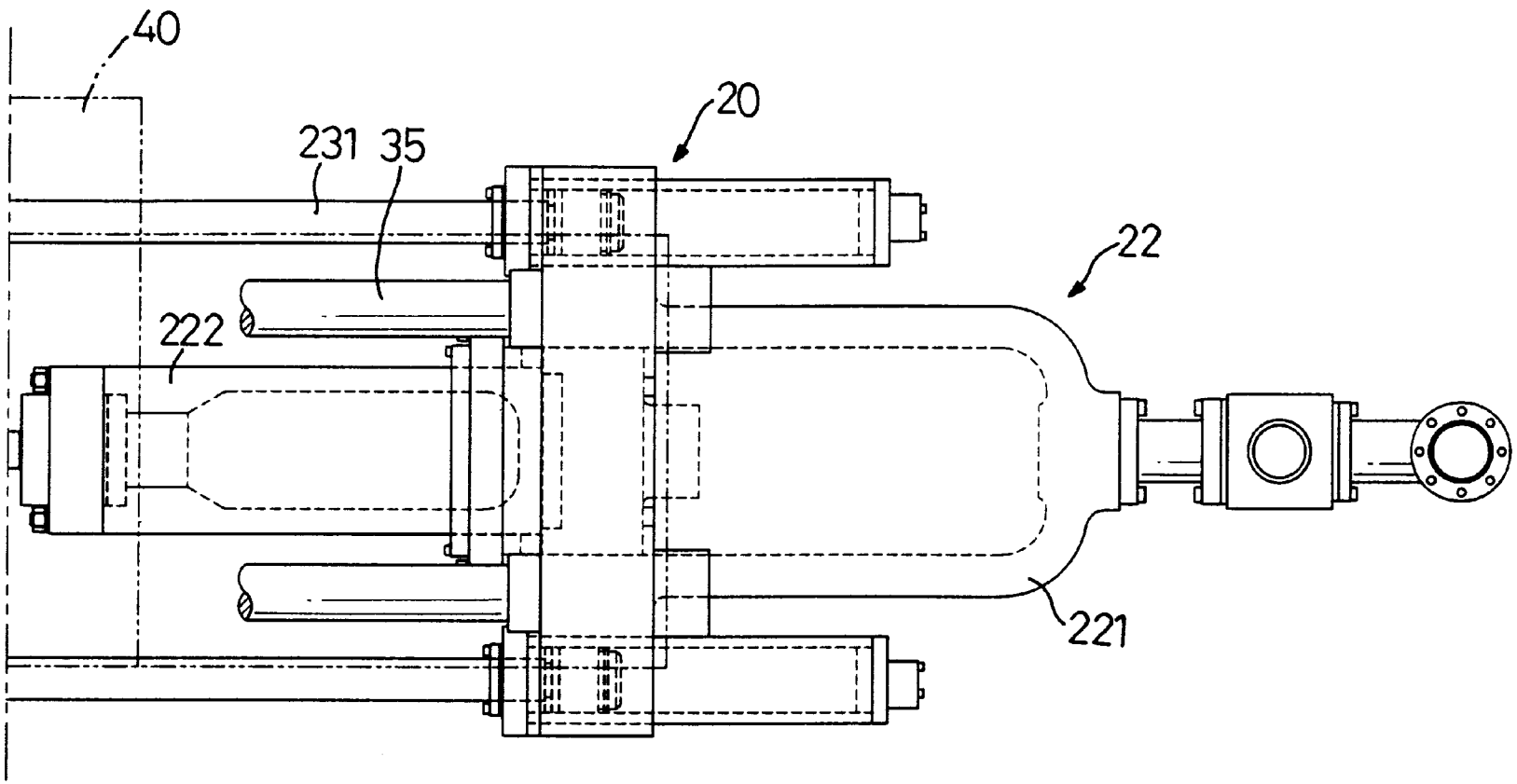
FIG. 8B is an operational partial top plan view of the automatic extruding machine in FIG. 1.
Figure 9A:
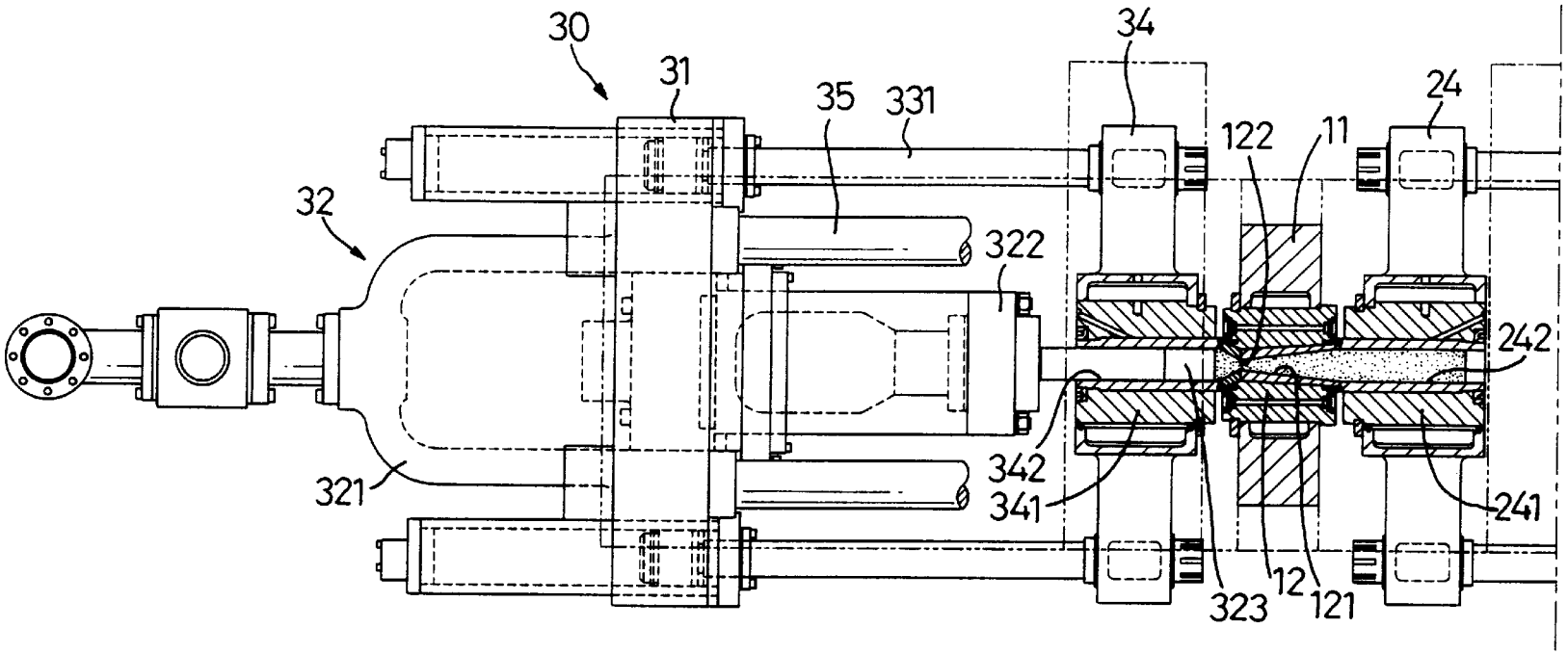
FIG. 9A is an operational partial top plan view of the automatic extruding machine in FIG. 1.
Figure 9B:
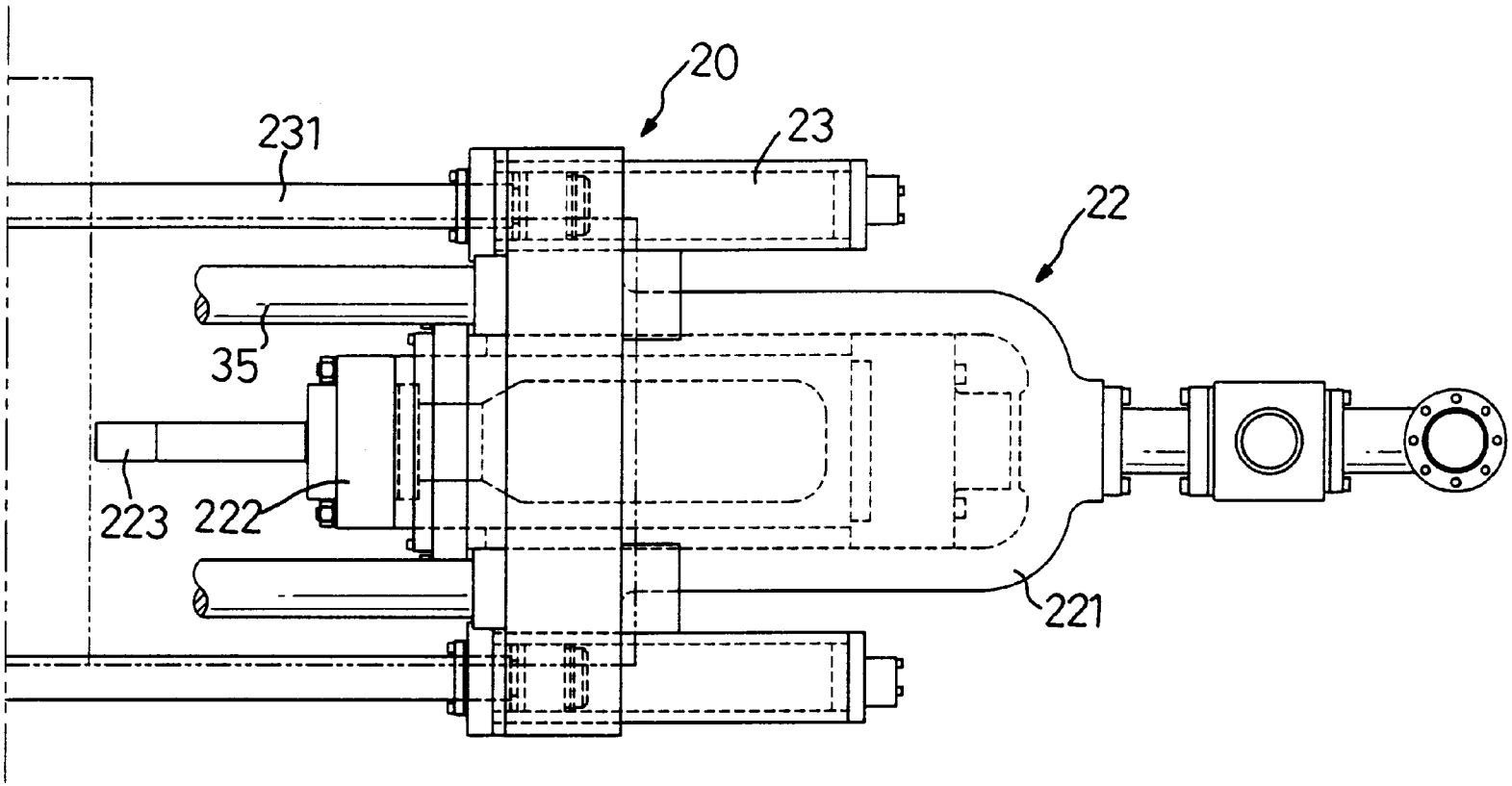
FIG. 9B is an operational partial top plan view of the automatic extruding machine in FIG. 1.

With reference to FIGS. 8 and 9, the piston (222) of the main cylinder (221) extends to push the original alloy (70) into the through hole (342) in the positioning mold (341) of the output extruding device (30) through the first hole (121), the neck (122) and the second hole (123) in the mold (12). The original alloy (70) is squeezed when passing through the neck (122) to make the grains of the original alloy (70) crystallize again to promote the physical property of the alloy, such as weldability or machinability. The piston (322) of the main cylinder (321) of the output extruding device (30) pushes the original alloy (70) into the through hole (242) in the positioning mold (241) of the input extruding device (20). The steps, as shown in FIGS. 8 and 9, may be repeated until the physical property of the original alloy (70) is promoted and the original alloy becomes a hot-finished alloy (71).

Figure 10A:
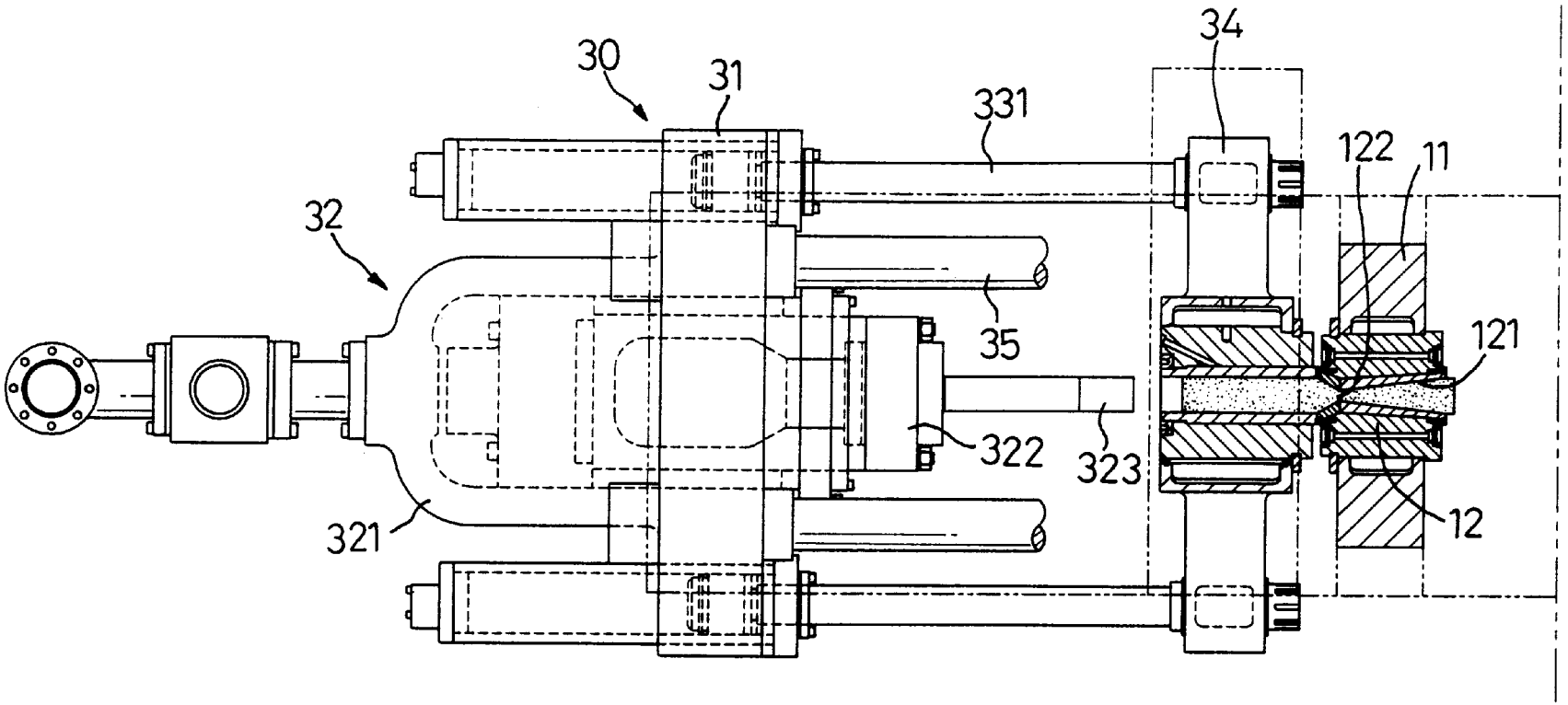
FIG. 10A is an operational partial top plan view of the automatic extruding machine in FIG. 1.
Figure 10B:
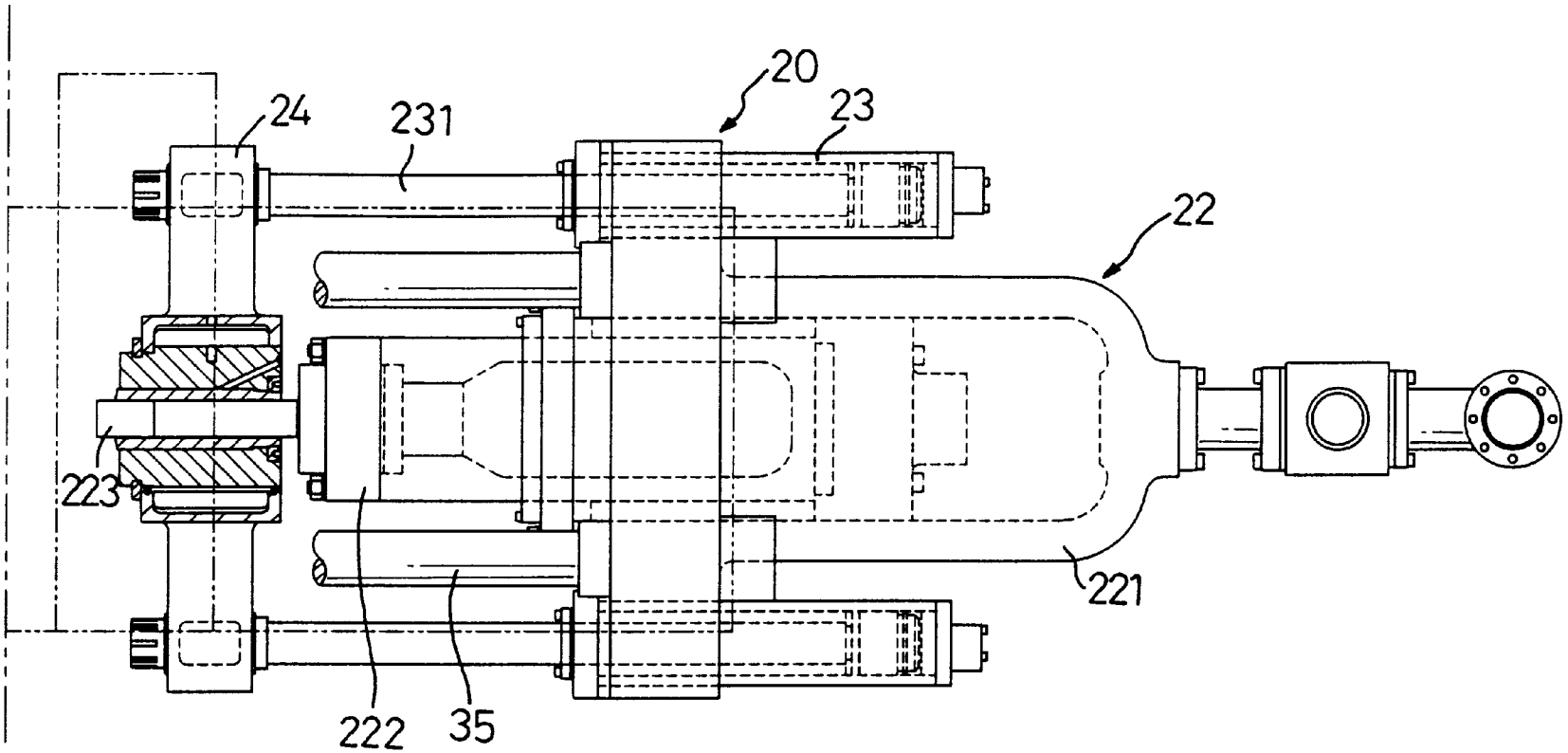
FIG. 10B is an operational partial top plan view of the automatic extruding machine in FIG. 1.

With reference to FIG. 10, the original alloy (70) is pushed into the through hole (342) in the positioning mold (341) of the output extending device (30) and the first hole (123) and the second hole (123) in the mold (12). The piston (222) of the main cylinder (221) of the input extruding device (20) is moved toward the main cylinder (221) and the moving seat (24) with the positioning mold (241) is moved toward the seat (21) of the input extruding device (20).

With reference to FIG. 6, the piston (621) extends downwardly from the cylinder (62) to drive the cutter (622) down to cut the alloy out of the first hole (121) in the mold (12).

Figure 11A:
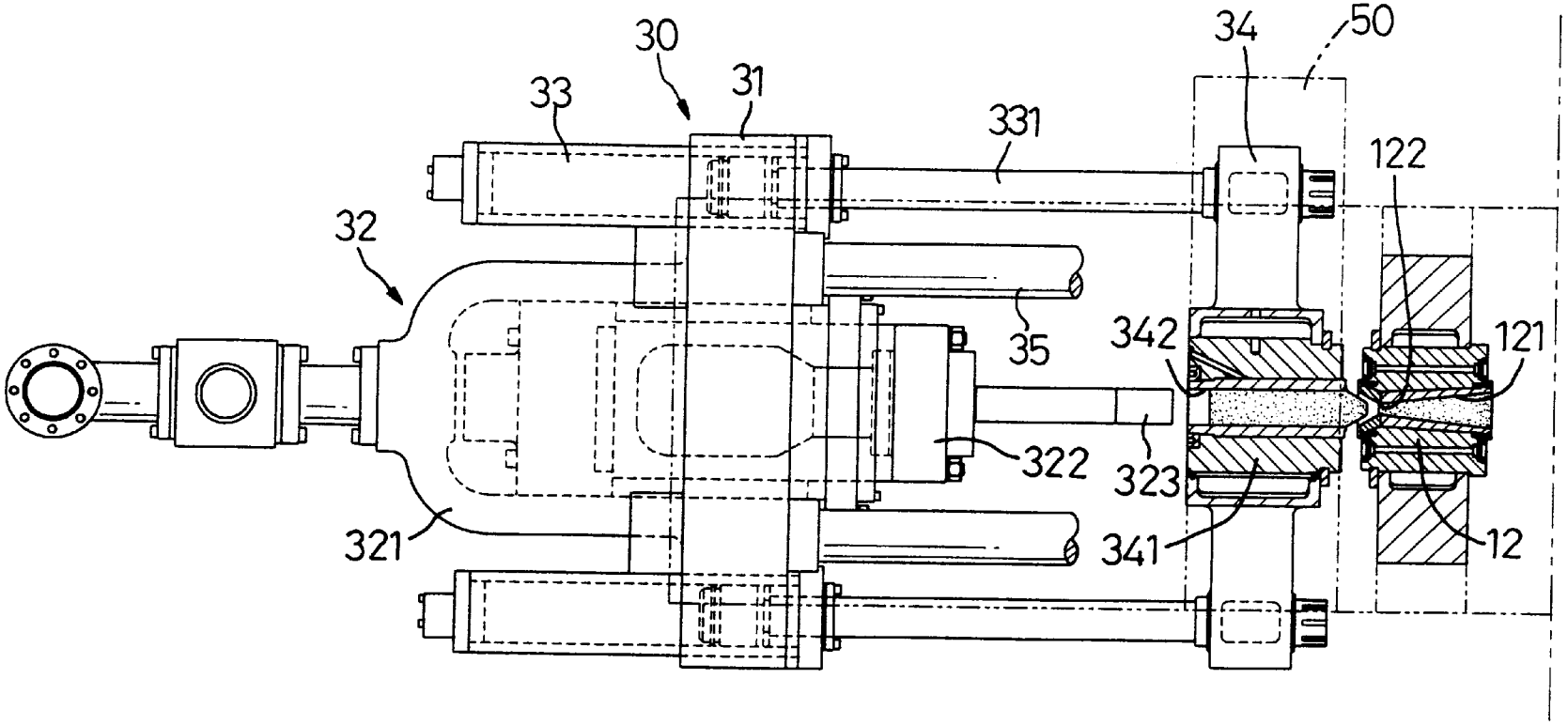
FIG. 11A is an operational partial top plan view of the automatic extruding machine in FIG. 1.
Figure 11B:
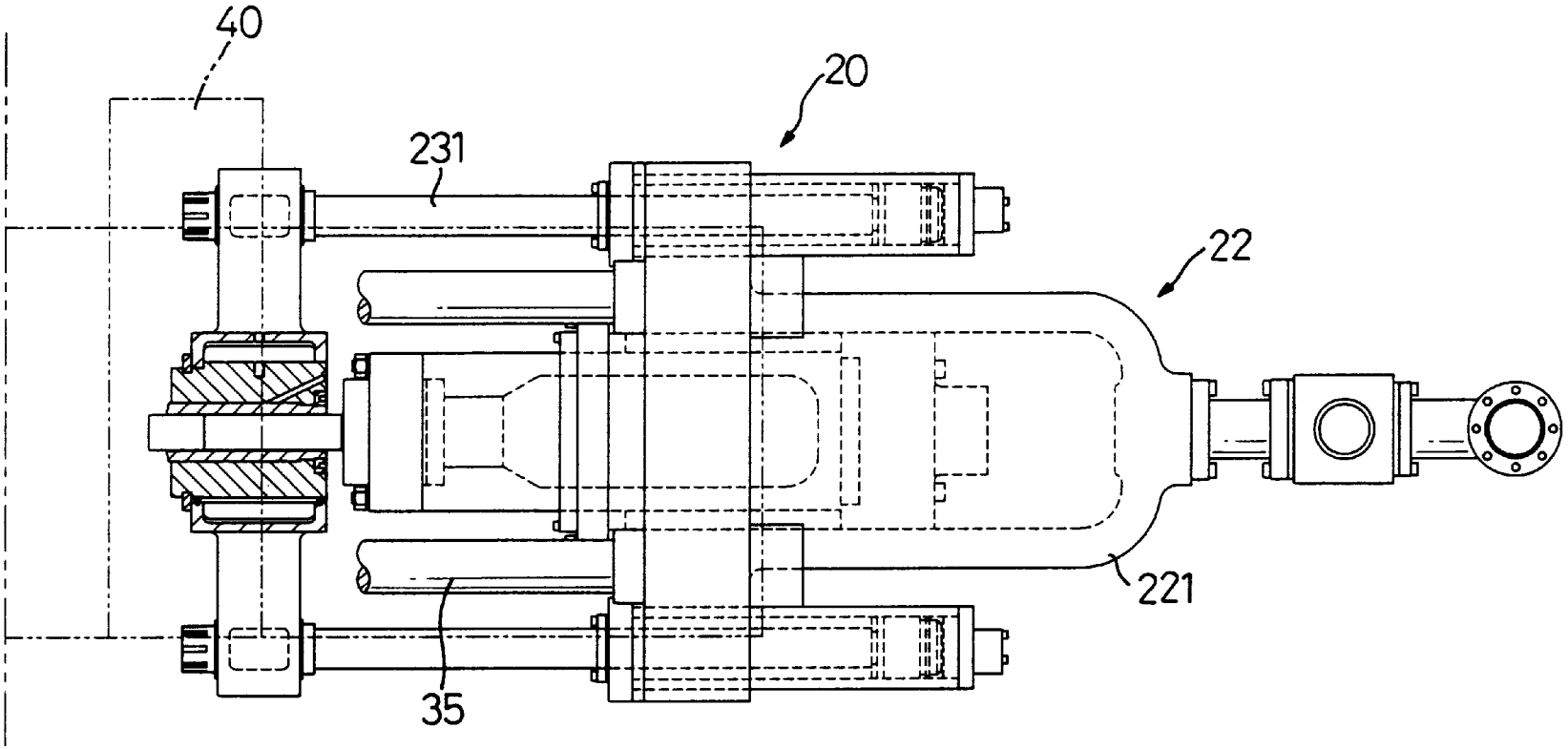
FIG. 11B is an operational partial top plan view of the automatic extruding machine in FIG. 1.
Figure 12A:
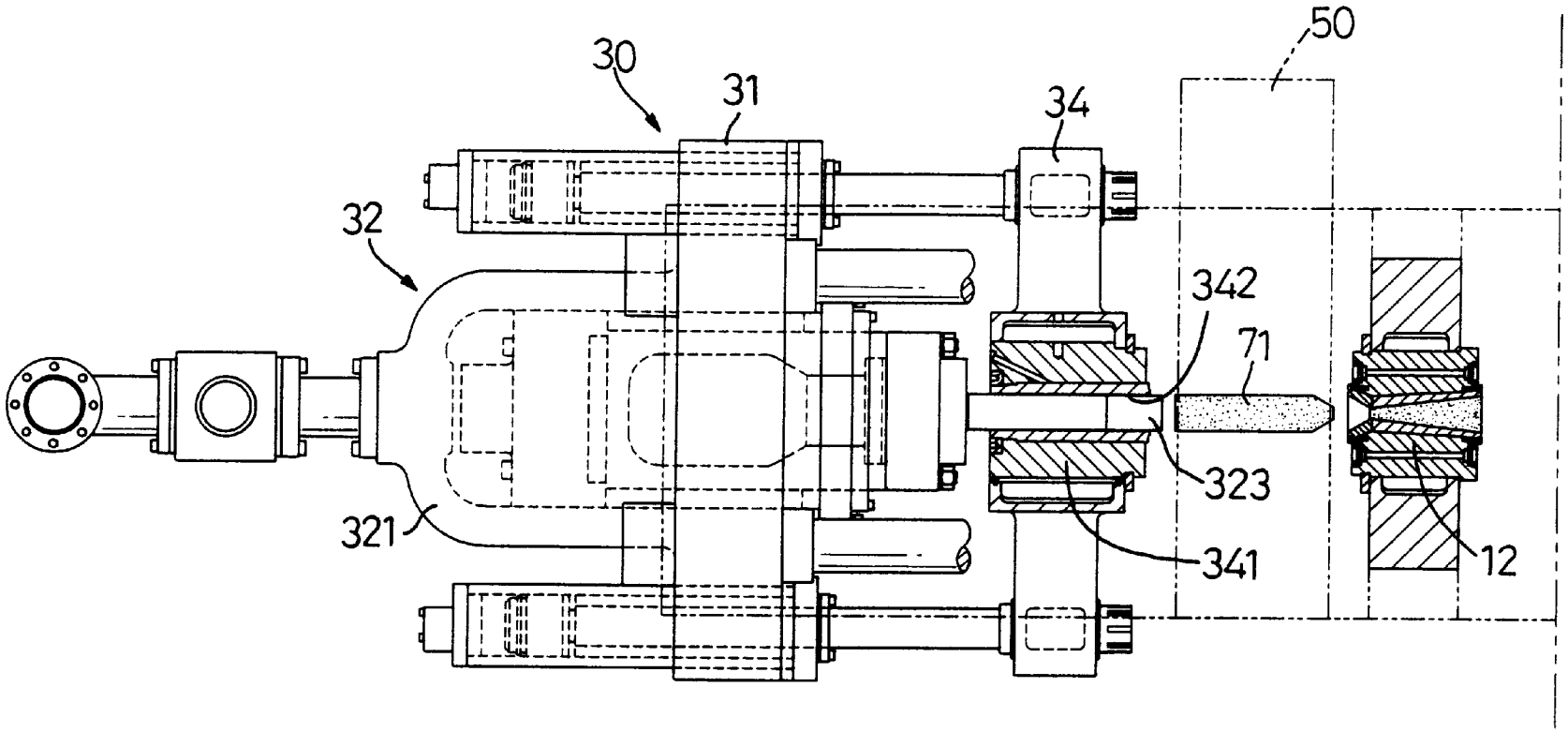
FIG. 12A is an operational partial top plan view of the automatic extruding machine in FIG. 1.
Figure 12B:
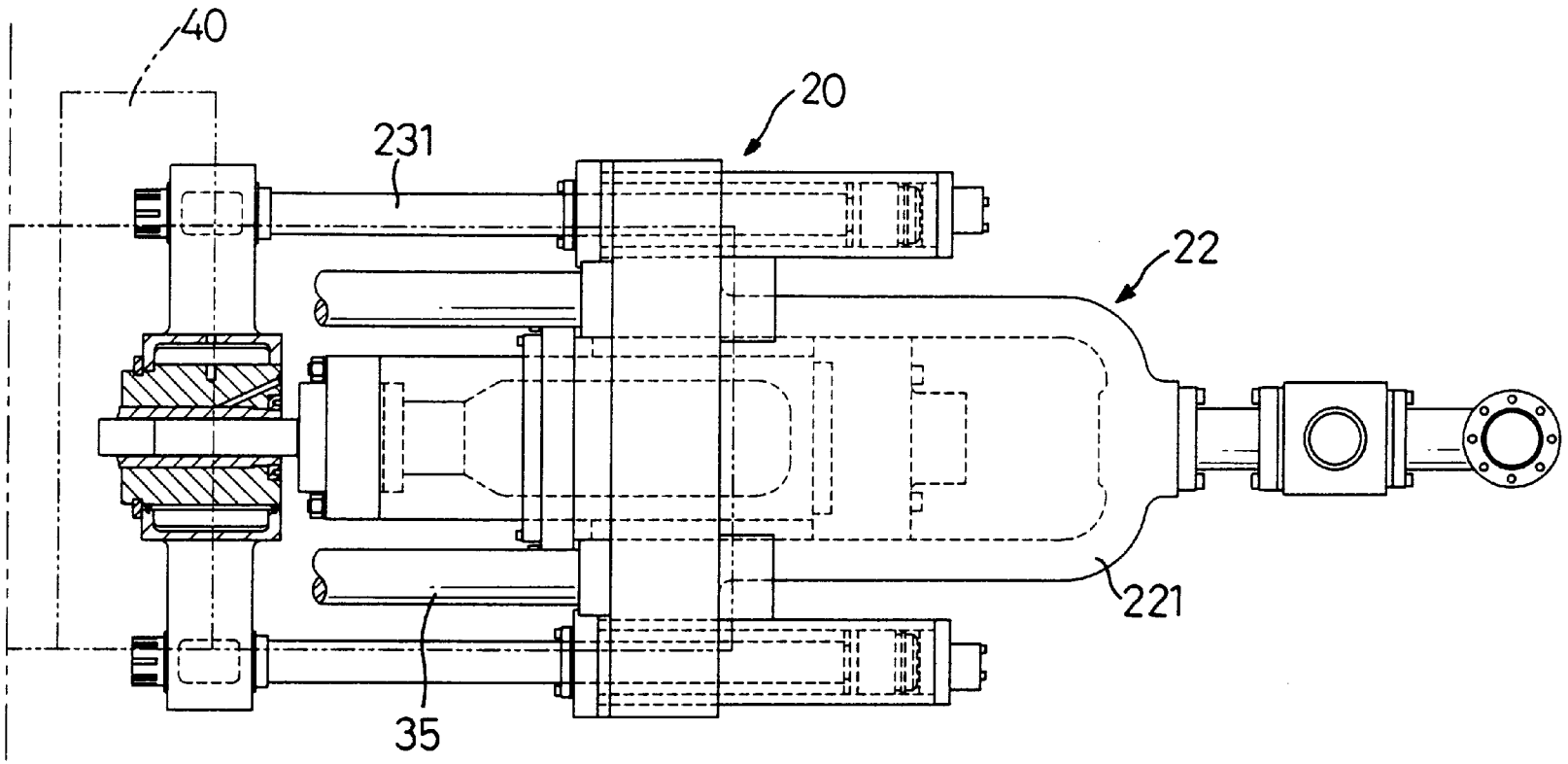
FIG. 12B is an operational partial top plan view of the automatic extruding machine in FIG. 1.
Figure 13:
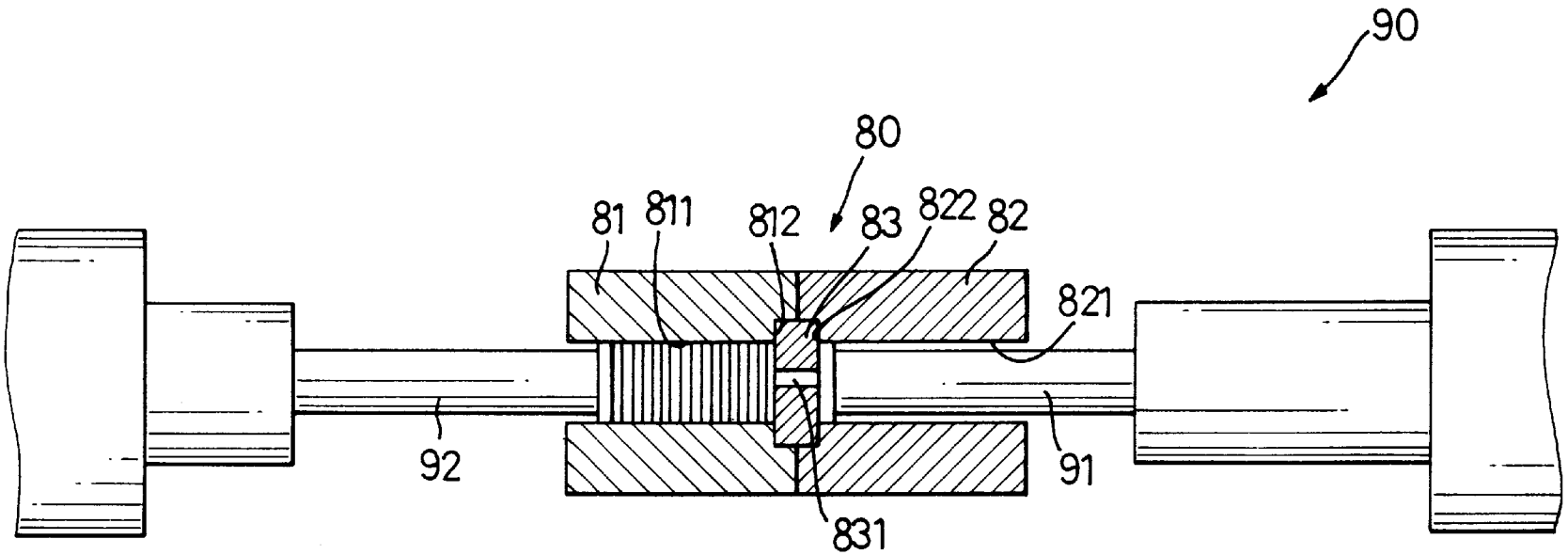
FIG.13 PRIOR ART
FIG. 13 is a partially front plan view of a conventional extruding machine in accordance with the prior art.

With reference to FIGS. 11 and 12, the piston (322) is moved back into the cylinder (321) and the cylinder (33) with the piston (331) drive the moving seat (34) toward the seat (31). The hot-finished alloy (71) is broken from the neck (122) because the hot-finished alloy is securely held in the through hole (342) in the positioning mold (341). The hot-finished alloy (71) is pushed away from the through hole (342) in the positioning mold (341) of the output extruding device (30) when the moving seat (34) moves toward the seat (31) of the output extruding device (30).

With reference to FIG. 5, the arm (54) with the support (56) is moved upwardly to pick up the hot-finished alloy (71) from the through hole (342). Then the piston (531) is moved back into the cylinder (53) to make the arm (54) move down. The hot-finished alloy (71) is stopped on the guiding plate (511) and rolls out of the base member (1) form the outlet (51) along the guiding plate (511) when the support (56) passes through the channel (512) because the length of the hot-finished alloy is greater than the width of the channel (512) in the guiding plate (511).

As described above, the automatic extruding machine in accordance with the present invention automatically performs all the steps of extruding an alloy, such as feeding, extruding and exporting. Consequently, the manufacturing cost is reduced and the manufacturing productivity is promoted. Furthermore, the original alloy must be heated over the recrystallization temperature so that the feeding device and the exporting device are necessary to prevent the worker from being injured due to the high temperature of the original alloy or the hot-finished alloy.

Although the invention has been explained in relation to its preferred embodiment, it is to be understood that many other possible modifications and variations can be made without departing from the spirit and scope of the invention as hereinafter claimed.

What is claimed is:

1. An automatic extruding machine comprising:

a base member;

a molding device mounted on a middle portion of the base member and including a frame and a mold detachably mounted on the frame, the mold including a first hole and a second hole each centrally and laterally defined in the mold, the first hole and the second hole communicating with each other, a neck formed in the mold between the first hole and the second hole;

an input extruding device mounted on the base member and connected to the molding device, the input extruding device including:

a seat securely attached to the base member;

a drive device mounted on the seat opposite to the mold;

a hard block reciprocally and co-axially mounted between the seat and the molding device relative to the first hole of the mold;

a moving seat reciprocally mounted between the molding device and the seat of the input extruding device; and a positioning mold mounted in and extending through the moving seat, the positioning mold corresponding to the mold and having a through hole defined to align with the first hole in the mold, the through hole in the positioning mold having a diameter equal to that of the first hole in the mold and slightly greater than that of the hard block of the input extruding device;

a feeding device mounted on the base member below the input extruding device, the feeding including an inlet defined in and extending to an outer periphery of the base member, and an actuating device mounted in the base member, the actuating device selectively extending to a position between the positioning mold and the hard block;

an output extruding device mounted on the base member and corresponding to the input extruding device, the output extruding device including:

a seat secured on the base member;

a drive device mounted on one side of the seat of the output extruding device opposite to the mold;

a hard block reciprocally and co-axially mounted between the seat of the output extruding device and the molding device relative to the second hole of the mold;

a moving seat reciprocally mounted between the molding device and the seat of the output extruding device; and a positioning mold mounted in and extending through the moving seat of the output extruding device, the positioning mold of the output extruding device corresponding to the mold and having a through hole defined to align with the second hole in the mold, the through hole in the positioning mold of the output extruding device having a diameter equal to that of the second hole in the mold and slightly greater than that of the hard block of the output extruding device; and an exporting device mounted on the base member below the output extruding device and including an outlet defined in and extending to an outer periphery of the base member, and an actuating device mounted in the base member, the actuating device of the exporting device selectively extending to a position between the positioning mold of the output extruding device and the hard block of the output extruding device.

2. The automatic extruding machine as claimed in claim 1 further comprising a cutting device mounted on a top of the molding device and directed toward the input extruding device, the cutting device including a cutter reciprocally mounted on the cutting device and having a sharpened edge directed toward the molding device.

3. The automatic extruding machine as claimed in claim 1, wherein the input extruding device comprises a main cylinder fixedly extending through the seat of the input extruding device and having a piston partially reciprocally received in the main cylinder of the input extruding device, the piston of the main cylinder of the input extruding device being co-axial relative to the first hole of in the mold and the hard block attached to a free end of the piston of the main cylinder of the input extruding device.

4. The automatic extruding machine as claimed in claim 2, wherein the input extruding device comprises a main cylinder fixedly extending through the seat of the input extruding device and having a piston partially reciprocally received in the main cylinder of the input extruding device, the piston of the main cylinder of the input extruding device being co-axial relative to the first hole of in the mold and the hard block attached to a free end of the piston of the main cylinder of the input extruding device.

5. The automatic extruding machine as claimed in claim 3, wherein the input extruding device comprises at least two auxiliary cylinders diametrically mounted on the side of the seat of the input extruding device opposite to the mold relative to the main cylinder of the input extruding device, each auxiliary cylinder having a piston reciprocally extending through the seat of the input extruding device toward the molding device and the moving seat of the input extruding device mounted on a free end of the piston of the auxiliary cylinder of the input extruding device.

6. The automatic extruding machine as claimed in claim 4, wherein the input extruding device comprises at least two auxiliary cylinders diametrically mounted on the side of the seat of the input extruding device opposite to the mold relative to the main cylinder of the input extruding device, each auxiliary cylinder having a piston reciprocally extending through the seat of the input extruding device toward the molding device and the moving seat of the input extruding device mounted on a free end of the piston of the auxiliary cylinder of the input extruding device.

7. The automatic extruding machine as claimed in claim 1, wherein the actuating device of the feeding device comprises:

a base mounted on the base member and a pair of ears extending from the base;

a feeding cylinder pivotally mounted on the ears, the feeding cylinder having a piston partially and reciprocally received in the feeding cylinder;

a bent arm pivotally mounted on the base member and selectively corresponding to the inlet, the bent arm including a first end pivotally connected to a free end of he piston of the feeding cylinder and a second end having a V-shaped support attached to the radial-shaped arm of the feeding device; and a lip extending from one side of the support of the feeding device and corresponding to the inlet.

8. The automatic extruding machine as claimed in claim 2, wherein the actuating device of the feeding device comprises:

a base mounted on the base member and a pair of ears extending from the base;

a feeding cylinder pivotally mounted on the ears, the feeding cylinder having a piston partially and reciprocally received in the feeding cylinder;

a bent arm pivotally mounted on the base member and selectively corresponding to the inlet, the bent arm including a first end pivotally connected to a free end of he piston of the feeding cylinder and a second end having a V-shaped support attached to the radial-shaped arm of the feeding device; and a lip extending from one side of the support of the feeding device and corresponding to the inlet.

9. The automatic extruding device as claimed in claim 1, wherein the output extruding device comprises a main cylinder fixedly extending through the seat of the output extruding device and having a piston partially reciprocally received in the main cylinder of the output extruding device, the piston of the main cylinder of the output extruding device being co-axial relative to the second hole of in the mold and the hard block of the output extruding device attached to a free end of the piston of the main cylinder of the input extruding device.

10. The automatic extruding device as claimed in claim 2, wherein the output extruding device comprises a main cylinder fixedly extending through the seat of the output extruding device and having a piston partially reciprocally received in the main cylinder of the output extruding device, the piston of the main cylinder of the output extruding device being co-axial relative to the second hole of in the mold and the hard block of the output extruding device attached to a free end of the piston of the main cylinder of the input extruding device.

11. The automatic extruding machine as claimed in claim 9, wherein the output extruding device comprises at least two auxiliary cylinders diametrically mounted on the side of the seat of the output extruding device opposite to the mold relative to the main cylinder of the output extruding device, each auxiliary cylinder of the output extruding device having a piston reciprocally extending through the seat of the output extruding device toward the molding device and the moving seat of the output extruding device mounted on a free end of the piston of the auxiliary cylinder of the output extruding device.

12. The automatic extruding machine as claimed in claim 10, wherein the output extruding device comprises at least two auxiliary cylinders diametrically mounted on the side of the seat of the output extruding device opposite to the mold relative to the main cylinder of the output extruding device, each auxiliary cylinder of the output extruding device having a piston reciprocally extending through the seat of the output extruding device toward the molding device and the moving seat of the output extruding device mounted on a free end of the piston of the auxiliary cylinder of the output extruding device.

13. The automatic extruding machine as claim 1, wherein the actuating device of the exporting device comprises:

a base mounted on the base member and a pair of ears extending from the base of the actuating device;

a cylinder pivotally mounted on the pair of ears, the cylinder includes a piston partially and reciprocally received in the cylinder of the exporting device;

a bent arm pivotally mounted on the base member and corresponding to the outlet, the bent arm including a first end pivotally connected to the a free end of the piston of the cylinder and a second end having a V-shaped support attached to the bent arm of the exporting device; and a lip extending from one side of the V-shaped support of the exporting device and corresponding to the outlet.

14. The automatic extruding machine as claim 2, wherein the actuating device of the exporting device comprises:

a base mounted on the base member and a pair of ears extending from the base of the actuating device;

a cylinder pivotally mounted on the pair of ears, the cylinder includes a piston partially and reciprocally received in the cylinder of the exporting device;

a bent arm pivotally mounted on the base member and corresponding to the outlet, the bent arm including a first end pivotally connected to the a free end of the piston of the cylinder and a second end having a V-shaped support attached to the bent arm of the exporting device; and a lip extending from one side of the V-shaped support of the exporting device and corresponding to the outlet.

15. The automatic extruding machine as claimed in claim 13, wherein the exporting device comprises a guiding plate mounted in the base member, the guiding plate including a first end connected to a lower edge of the outlet and a second having a channel defined to allow the V-shaped support of the actuating device of the exporting device passing the guiding plate, the first end of the guiding plate has a height lower than that of the second end of the guiding plate relative to the horizon.

16. The automatic extruding machine as claimed in claim 14, wherein the exporting device comprises a guiding plate mounted in the base member, the guiding plate including a first end connected to a lower edge of the outlet and a second having a channel defined to allow the V-shaped support of the actuating device of the exporting device passing the guiding plate, the first end of the guiding plate has a height lower than that of the second end of the guiding plate relative to the horizon.

17. The automatic extruding machine as claimed in claim 2, wherein the cutting device comprises a bracket mounted on a top of the molding device and a cylinder mounted on the bracket toward the molding device, the cylinder of the cutting device having a piston partially reciprocally received in the cylinder of the cutting device and the cutter of the cutting device attached to a free end of the piston of the cylinder of the cutting device.

* * * * *